US005718274A

United States Patent [19]

Streeter

[11] Patent Number: 5,718,274

[45] Date of Patent: Feb. 17, 1998

[54] ADJUSTABLE SCREEN HAVING MAGNETICALLY STABILIZED LOUVERS

[76] Inventor: Edward C. Streeter, 89 Park Place, Park Parade, Harrogate, North Yorkshire, United Kingdom, HG1 5NS

[21] Appl. No.: 691,094

[22] Filed: Aug. 1, 1996

[51] Int. Cl.[6] ..... E06B 9/26

[52] U.S. Cl. ..... 160/176.1 P; 49/74.1

[58] Field of Search ..... 160/166.1 R, 176.1 R, 160/176.1 P, 107, 1, 7; 49/89.1, 90.1, 92.1, 91.1, 74.1, 82.1, 86.1; 454/221, 224, 278

[56] References Cited

U.S. PATENT DOCUMENTS

| | | | |
|---|---|---|---|
| 3,342,244 | 9/1967 | Streeter, Jr. . | |
| 3,384,147 | 5/1968 | Smith | 160/107 |
| 3,524,281 | 8/1970 | Streeter, Jr. . | |
| 4,593,218 | 6/1986 | Streeter | 160/176.1 P X |
| 4,684,911 | 8/1987 | Streeter | 160/176.1 P X |
| 4,797,591 | 1/1989 | Streeter . | |
| 5,357,712 | 10/1994 | Streeter . | |

*Primary Examiner*—David M. Purol

*Attorney, Agent, or Firm*—Brumbaugh Graves Donohue & Raymond

[57] ABSTRACT

A screen having louvers rotatable about parallel axes under the control of magnetic fields and attached to permanent magnets contained in a magnetically permeable housing so dimensioned relative to the spacing between adjacent magnets that each magnet exerts a stabilizing torque on like magnets of neighboring louvers to maintain a parallel attitude between all of the louvers.

3 Claims, 12 Drawing Sheets

ADJUSTABLE SCREEN HAVING MAGNETICALLY STABILIZED LOUVERS

BACKGROUND OF THE INVENTION

1. Field of the Invention

This invention relates to screens of adjustable louvers suitable for placing inside double-glazed enclosures, and it particularly concern screens wherein the louvers are attached to permanent magnet rotors under the control of electromagnetic fields.

2. Description of the Prior Art

U.S. Pat. No. 3,524,281, issued Aug. 18, 1970, discloses a screen having ribbon-like louvers supported only at their ends, at least one end of each louver being attached to a separate bipolar disk-shaped permanent magnet rotor. The louver attitude is determined, except at open or dosed louver limits, by equilibrium between a control torque produced by a transverse electromagnetic field and a restoring torque that tends to maintain each rotor at a predetermined angle of repose. The transverse field is created by control current flowing through an elongated coil extending the length of each beam that contains the rotors.

The above-mentioned patent teaches that the bipolar rotors at corresponding ends of adjacent louvers are exposed to reciprocal magnetic coupling torques tending to align the magnetic axes of the rotors in the plane of the screen and thus serve as restoring torques.

Relying upon coupling torques to act as the restoring torque severely limits the angular range of louver attitudes because the coupling torque varies as the sine of twice the angle $\rho$ between the magnetic axis of each rotor and a line connecting the centers of the rotors. This means that the restoring torque has maxima at $\rho=\pm 45°$ and negative slopes beyond this range, reaching zero at $\rho=\pm 90°$.

This patent further discloses that "a magnetically permeable body is provided parallel to the plane passing through the axes of the rotors at a suitable distance from this axial plane. The magnetism induced in the magnetically permeable body produces a locking torque on each permanent magnet rotor that tends to balance the coupling torque between adjacent permanent magnet rotors at all angles for parallel louvers. The ratio of the spacing between the axes of adjacent magnets to the spacing between the magnetically permeable body and the plane containing the rotational axes of the magnets is predetermined to give the screen desired torque characteristics". The complete balance of the coupling torque by means of an equal and opposing locking torque was considered not advisable because the patent states that "Unfortunately, the louvers are simultaneously rendered sensitive to unbalanced gravity torques and momentary disturbing torques. The provision of balancing and viscous damping arrangements adds to the manufacturing cost of the screen".

However, torque balance was not even possible with the prior apparatus because the field of the rotor magnets was insufficiently similar to the field of dipoles to achieve this condition. Erroneous speculation arose in the absence of empirical observation or sufficient mathematical analysis.

The present invention contradicts the prior misconception by revealing that the balanced mode gives rise to a magnetic stabilizing torque that tends to keep the louvers parallel at all attitudes. This torque renders the louver-magnet assemblies less sensitive to differences in operating parameters, such as static unbalance, frictional torque and magnetic moment.

Torque balance offers the further advantage of eliminating the prior source of restoring torque with its unsatisfactory double-sinusoidal characteristic end allowing introduction of a new source of restoring torque with a sinusoidal shape permitting a full range of louver attitudes.

SUMMARY OF THE INVENTION

The prior art discloses an adjustable screen having louvers coaxially attached with torsional rigidity to respective bipolar permanent magnets rotatable about parallel equally spaced axes that are equidistant from magnetically permeable parallel boundary walls. The present invention predetermines the spacing between the boundary walls relative to the axial spacing to balance out reciprocal magnetic coupling torque on the rotors by means of equal and opposite locking torque caused by images induced in the boundary walls and provides means producing a magnetic field directed parallel to the boundary walls for exerting a torque on the rotors tending to turn them to a predetermined attitude. This torque can be conveniently exterted by small permanent magnets fixed on the centreline intersecting the rotor axes.

The invention from a slightly different viewpoint contemplates predetermining the separation of parallel sidewalls, which magnetically shield a series of equally spaced permanent magnet rotors, relative to the spacing of the rotor axes of rotation in order to minimize a torque on the rotors that varies according to twice the sine of the angle of rotation and providing a fixed permanent magnetic field that exerts a torque on the rotors that varies according to the sine of the angle of rotation and tends to turn the rotors to a predetermined attitude of repose.

DETAILED DESCRIPTION

The operation of the present invention can be understood from a study of magnetically coupled dipoles limited by parallel magnetically permeable boundaries of infinite extent.

Actual magnets can be represented by dipoles in a mathematical model if the magnets are given a shape that is an adequate approximation to an elliptic spheroid, because a uniformly magnetized spheroid produces the same external effect as a dipole of equal magnetic moment placed at its center and magnetized in the same direction.

Figure 1:
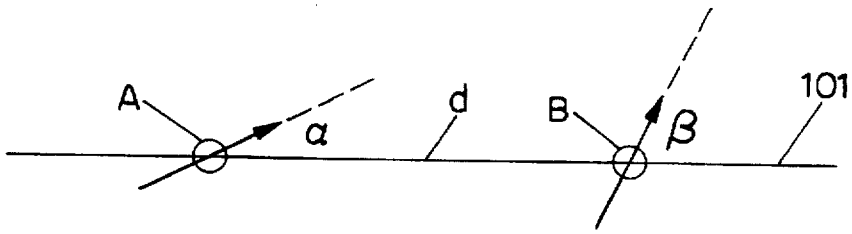
FIG. 1 is a diagram of a pair of coupled rotatable magnetic dipoles A and B illustrating their geometrical relationship, which determines the variation in coupling torque.

Referring to FIG. 1, a rotatable dipole magnet A of moment M positioned at a distance d from a rotatable dipole B of equal moment M is subject to a coupling torque $T_{ba}$ as follows:

$$T_{ba}=M^2(\sin\beta\cos\alpha-2\cos\beta\sin\alpha)/d^3 \qquad 1)$$

where α and β are angles of the magnetic axes of the dipoles A and B, respectively, with a line 101 through the dipole centers.

There is a corresponding coupling torque $T_{ab}$ on dipole B exerted by dipole A, which is identical to 1) except that α and β are interchanged. Namely, $$T_{ab}=M^2(\sin\alpha\cos\beta-2\cos\alpha\sin\beta)/d^3 \qquad 2)$$

The magnetic axes of dipoles A and B tend to rotate into a parallel relationship. This effect is made clear by replacing α by an equivalent angle α=β+Δ, where Δ is the difference between α and β. The torque 1) on dipole A can now be expressed as $$T_{ba}=-\tfrac{1}{2}M^2[\sin 2\beta\cos\Delta+(3+\cos 2\beta)\sin\Delta]/d^3 \qquad 3)$$

Both dipoles continue to turn toward each other until the angular difference Δ becomes so small that cos Δ≅1 and sin Δ≅Δ(radian). The torque 3) is reduced to $$T_{ba}=-\tfrac{1}{2}M^2[\sin 2\beta]/d^3-\tfrac{1}{2}M^2\Delta[3+\cos 2\beta]/d^3 \qquad 4)$$

The second term in 4) acts to force the dipoles into a parallel attitude. A negative sign indicates that the angle α=β+ tends to decrease.

The angular difference vanishes when α=β, leaving a torque $$T=-\tfrac{1}{2}M^2[\sin 2\beta]/d^3 \qquad 5)$$

which disappears when β=0°.

Figure 2:
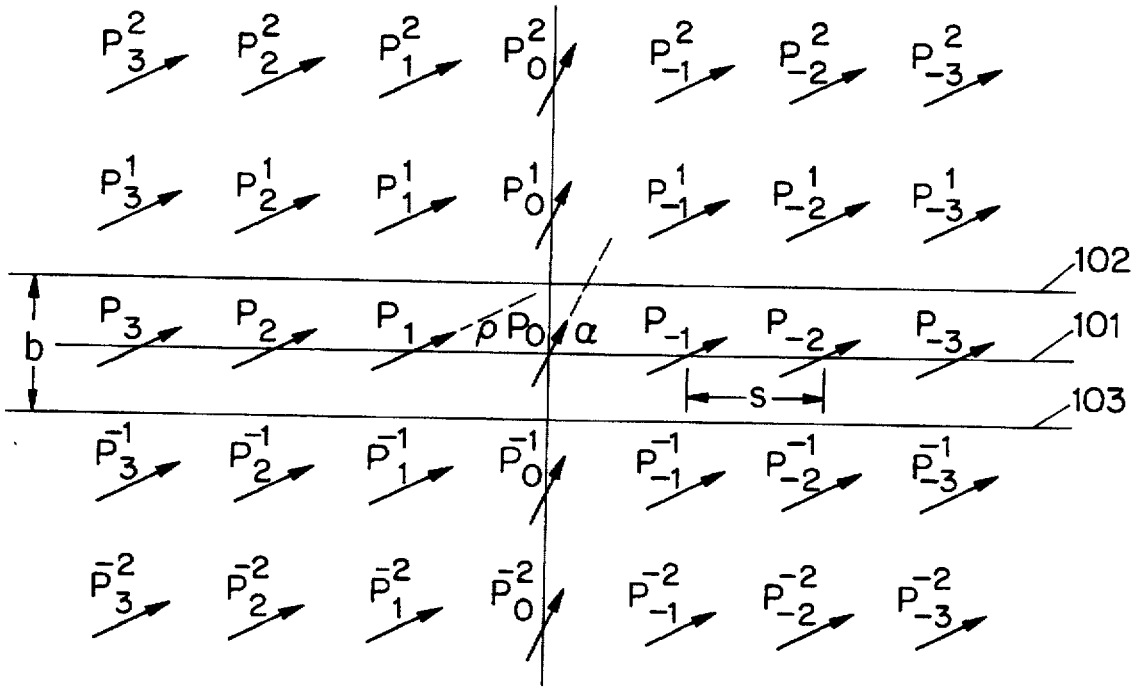
FIG. 2 is a of a series of coupled dipoles bounded by magnetically permeable walls and illustrating dipole images useful in explaining the origin of magnetic stabilizing torque.

The arrangement of &poles particularly relevant to the present invention is shown in FIG. 2 comprising a long series of rotatable dipoles $P_3$, $P_2$, $P_1$, $P_0$, $P_{-1}$, $P_{-2}$, and $P_{-3}$ centered on axis 101 with magnetic axes of all but dipole $P_0$ at an angle β=ρ from centerline 101, dipole $P_0$ being directed at an angle α=ρ+Δ. The dipoles are mutually spaced a distance d=s apart, the distance $P_0P_n$ being d=ns. For example, $d=P_0P_2=P_0P_{-2}=2s$ and thus $d^3=8s^3$.

A consideration of the factors $n^3s^3$ reveals that only the immediately adjacent dipoles $P_1$ and $P_{-1}$ exert a significant torque on $P_0$. Furthermore, absolute magnitudes are unimportant because we are primarily interested in torque ratios. Accordingly, we can assume a torque on $P_0$ twice that given by 1). Thus $$T=2M^2[\sin\rho\cos(\rho+\Delta)-2\cos\rho\sin(\rho+\Delta)]/s^3 \qquad 6)$$

Further torques are exerted on dipole $P_0$ by a pair of parallel steel walls 102 and 103 that bound the series of dipoles. The walls are equally spaced from the centerline 101 a distance b/2.

The torques caused by magnetism induced in the walls can be calculated by the method of images, which permits a magnetically permeable large plane equipotential surface to be replaced by an imaginary dipole or image that produces an equipotential surface coinciding with the original boundary conditions without altering the portion of the field between the walls. Although the theoretical magnetic moment of the image is (μ−1)/(μ+1) M, infinite permeability of the walls can be assumed with negligible error because μ>>1.

The coincidence of the two equipotential surfaces is achieved by positioning an image $P_n$ or $P_n$ a distance behind boundary 102 or 103 equal to that of the dipole $P_n$ from the front of the respective boundary. The assumption of infinitely permeable parallel plane boundaries spaced a distance apart gives rise theoretically to an infinite number of images at distances from $P_n$ equal to b, 2b, . . . kb, respectively. However, only the torques created by the first images are considered in order to be consistent with the assumption made concerning the torque 6). Furthermore, the symmetry of the locations of the dipoles $P_1$ and $P_{-1}$ on either side of $P_0$ and their images on opposite sides of the centerline 101 produces a torque balance.

Accordingly, the only effective image torques are those exerted by self-images $P_0$ and $P_0$. The sum $T_i$ of these torques is twice that given by 1) where $\alpha=\beta=\rho+\Delta+90°$ and b replaces d. Thus $$T_i=2M^2[\sin(\rho+\Delta)\cos(\rho+\Delta)]/b^3 \quad 7)$$

Observe that a positive sign results from the 90° relationship.

The total torque T on dipole $P_0$ is the sum of 6) and 7) and by making b=s we have $$T=2M^2[\sin\rho\cos(\rho+\Delta)-2\cos\rho\sin(\rho+\Delta)]+\sin(\rho+\Delta)\cos(\rho+\Delta)]/s^3 \quad 8)$$

The torque 8) vanishes when $\Delta=0$, and when $\Delta$ is small, say less than $10^0$, the torque 8) can be expressed as a stabilizing torque $T_s$ simplified to $$T_s=-M^2[(3-\cos 2\rho)\sin\Delta]/s^3 \quad 9)$$

Thus by choosing b=s we have eliminated magnetic torque on $P_0$ at all angles as long as the dipoles remain parallel and the dipoles are constrained to a parallel condition by the stabilizing torque $T_s$.

The separation b of the finite sidewalls of an actual beam is somewhat less than the axial distance s dictated by the previous theory in order to produce magnetic torque balance. For example, given s=16.0 mm, a satisfactory sidewall separation in a test screen is =15.0 mm.

The equation defining the magnetic field of a dipole is derived for points in space at distances from the center of the elementary magnet large compared to the distance between the magnetic poles. Since the subsequent calculations depend upon this assumption, the behavior of a series of practical rotor magnets inside a steel beam having parallel sidewalls can correspond to theory only if the spacing of the real poles is a minor fraction of the distance between the sidewalls.

If dipole B of FIG. 1 is fixed at angle $\beta$ and not free to rotate, the coupling torque $T_{ba}$ given by 1) causes dipole A to rotate until the torque vanishes at $$\tan\beta-2\tan\alpha-0 \quad 10)$$

Thus $$\alpha=\tan^{-1}(\tan\beta/2) \quad 11)$$

Figure 3:
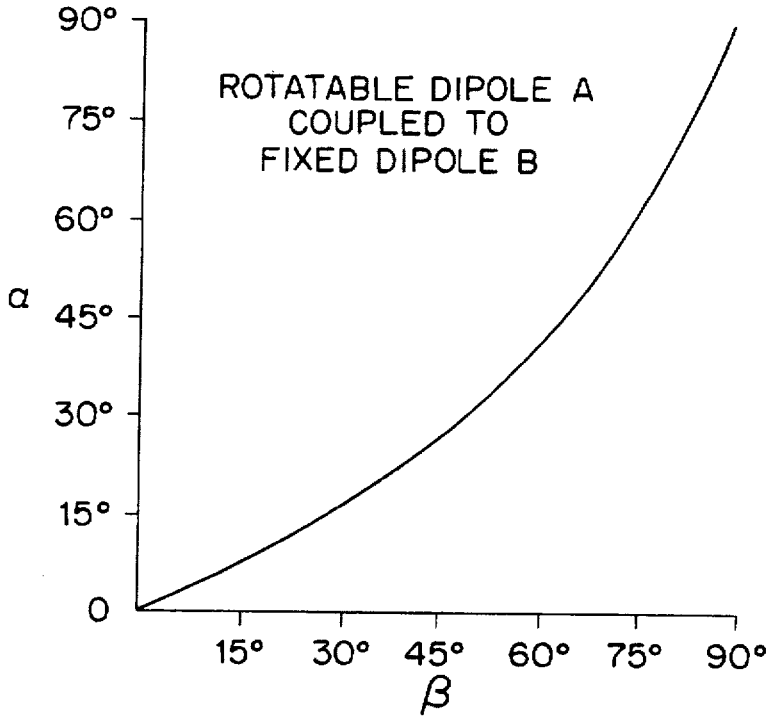
FIG. 3 is a graph of the angular relationship between rotatable dipole A of FIG. 1 and a fixed dipole B.

The curve defined by 11) is shown in FIG. 3.

Following the above reasoning a pair of rotor magnets can be arranged a distance s apart in a space remote from magnetically permeable material, and the non-linear angular relationship of their magnetic axes can be compared with the curve of FIG. 3.

Fortunately small square right prisms of sintered ceramic ferrite having the long dimension coaxial with the axis of rotation and the magnetic axis perpendicular thereto are satisfactory. This material is cost-effective and widely available.

Precise torque balance is difficult to maintain in a practical beam because image torques $T_1$ vary inversely as the third power of the sidewall separation, as shown in 8). This means that torque balance is very sensitive to variation in the beam wall spacing, and residual torques of either sense of rotation tend to occur along the length of a beam. Fortunately, the provision of a restoring torque of modest amplitude and favorable sinusoidal characteristic suppresses the effect of these residual double-sinusoidal torques.

The restoring torque $T_r$ is provided by a fixed dipole aligned with the centerline 101 and positioned at the mid-point between adjacent dipole axes of rotation 104. If rotatable dipole B in 1) is replaced by a fixed dipole of moment m, angle $\alpha=\rho$, angle $\beta=0°$ and d=s/2, the restoring torque on dipole A can be expressed as $$T_r=-MmK\sin\rho \quad 12)$$

where $K=16/s^3$.

There is a corresponding restoring torque on dipole B.

The control torque $T_c$ on dipole A produced by a transverse direct electromagnetic field is proportional to the current i flowing through n turns of coils that extend the length of the series of rotatable dipoles and can be expressed as $$T_c=iMnC\cos\rho \quad 13)$$

where C is a proportion constant including the predetermined spatial relationships of the coils. Equilibrium occurs when $T_r$ and $T_c$ equate to zero. Thus $$-mK\sin\rho+inC\cos\rho=0 \text{ and}$$

$$\rho=\tan^{-1}inC/mk \quad 14)$$

Figure 4:
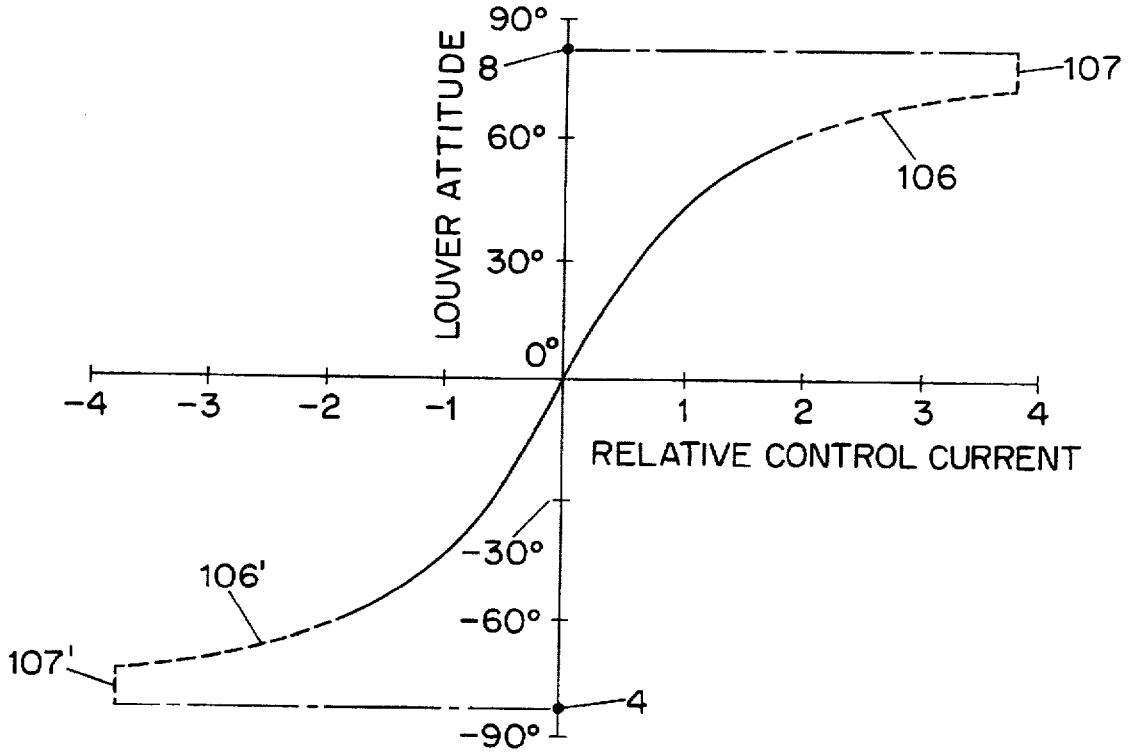
FIG. 4 is a graph of the angle of a dipole that is under the influence of a restoring torque as a function of relative control current.

This relationship between the dipole angle $\rho$ and the control current is shown FIG. 4.

The moment m of the restoring torque magnet is kept small to minimize the necessary control current i for a given dipole angle. This criterion is practicable because the stabilizing torque, which is a function of $M^2$ tends to maintain parallelism between dipoles. The range of current normally does not exceed 2, where 1 corresponds to 45°. Greater currents are only momentarily employed to achieve a latched closed attitude of the louvers, as will be explained hereinafter.

A SPECIFIC EMBODIMENT

Figure 5:
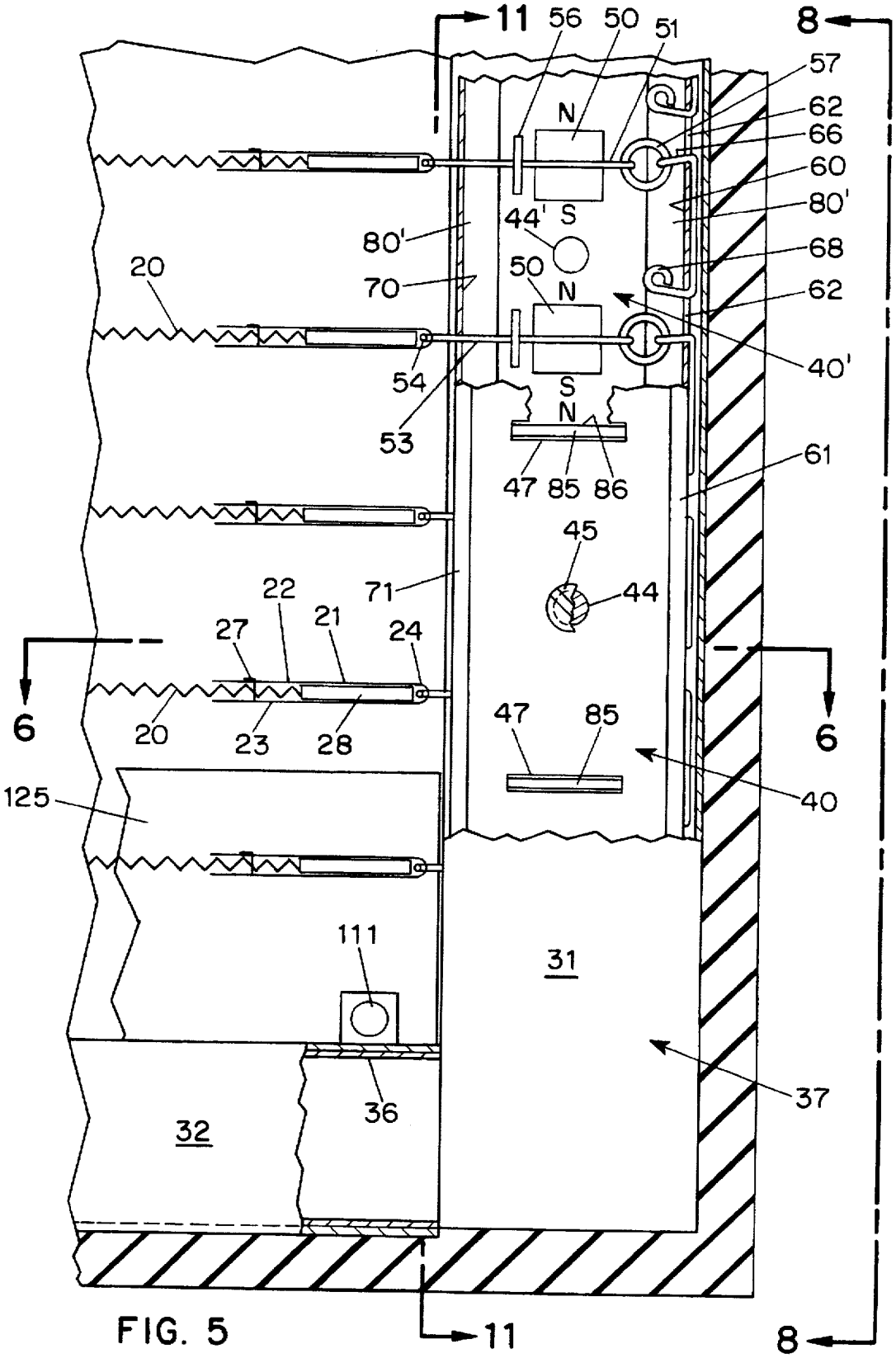
FIG. 5 is a front elevation viewed from indoors of a corner of an electromagnetically operated screen having magnetically stabilised louvers. The glass plate facing indoors has been removed and portions of the screen beam broken away to reveal internal construction.
Figure 8:
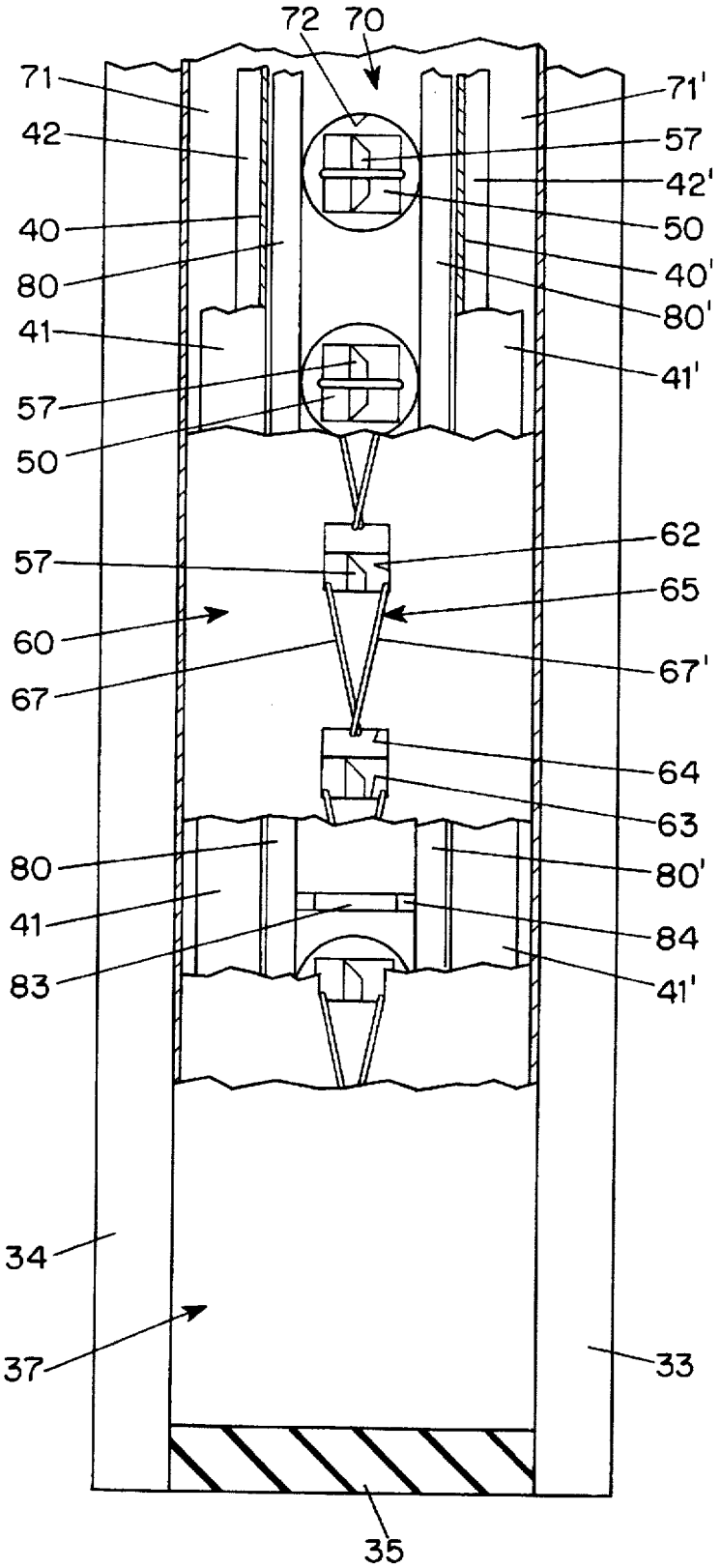
FIG. 8 is an elevation of the edge of the screen of FIG. 5, looking parallel to the rotational axes of the louvers with the beam cover broken away to reveal internal construction.

FIG. 5 discloses the lower fight corner of an electromagnetically adjustable screen wherein an array of ribbon-like louvers 20 are supported by their ends under tension for limited rotation about parallel uniformly spaced coplanar axes 104. The louvers have terminals 21 attached to a steel beam 31 on the right side of the screen and a corresponding beam (not shown) at the other ends of the louvers. The two beams are held apart against the combined tension of the louvers by a bottom strut 32 and a similar top strut (not shown) to form a rectangular time, which is covered by a pair of parallel glass plates 33 and 34. Plate 34, shown in FIGS. 5, 8 and 11, has been omitted from FIG. 5 to improve clarity of illustration. A sealant 35 around the periphery of the frame joins the glass plates 33 and 34 and completes an hermetically sealed enclosure for the array of louvers.

A permanent magnet rotor 50 of sintered ceramic ferrite, as previously described, is connected with torsional rigidity to each louver terminal 21 and is contained within the beam 31 where it is rotatably suspended between parallel steel channels 40 and 40$^1$, which are physical counterparts of the theoretical magnetically permeable boundary planes 102 and 103. Accordingly, the distance between the faces of the channels 40 and 40$^1$ is predetermined relative to the spacing between the axes of rotation of adjacent magnets 50 to balance out the reciprocal magnetic coupling torques.

Figure 11:
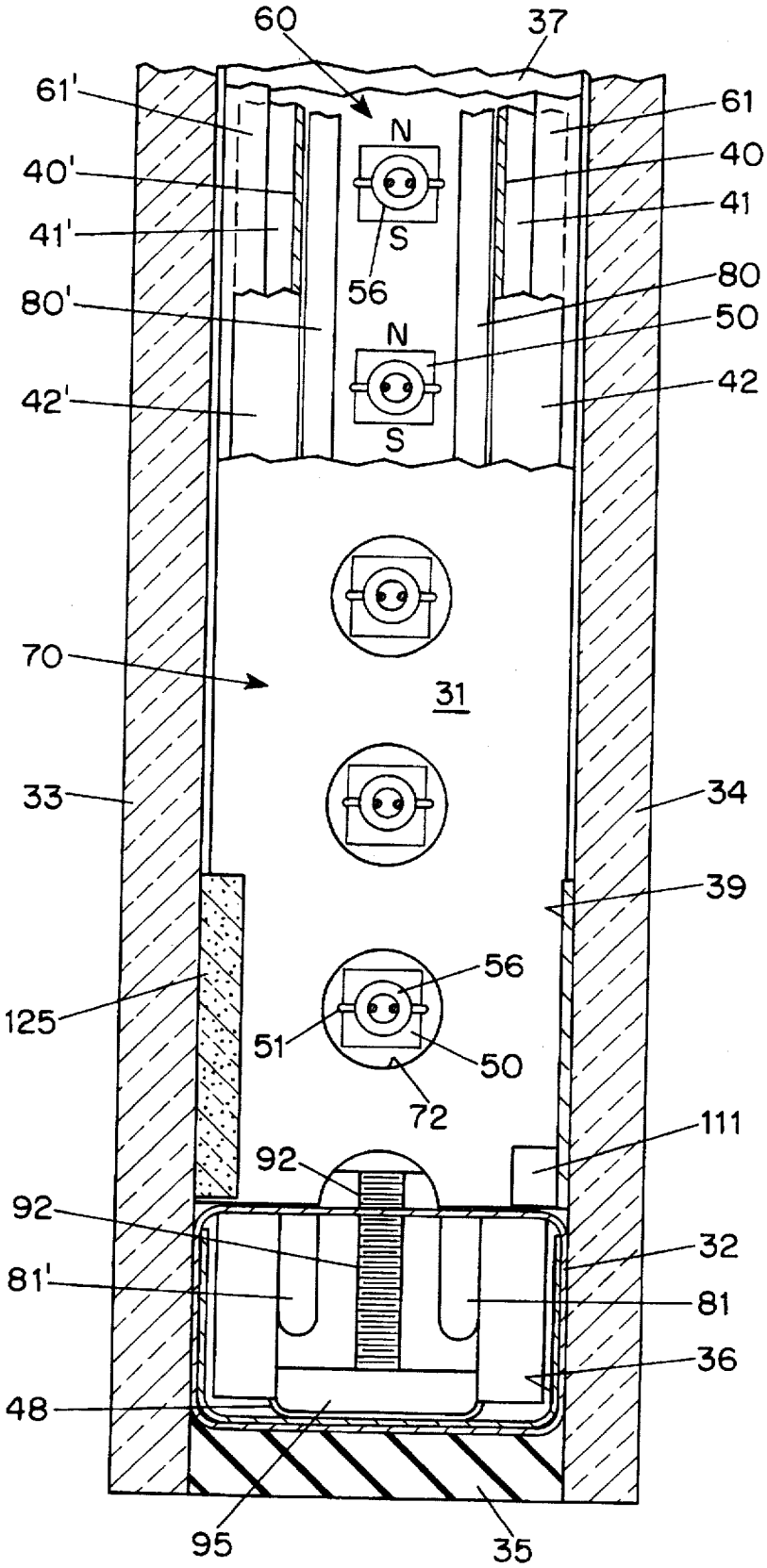
FIG. 11 is an elevational section taken along dashed line 11—11 of FIG. 5, looking in the opposite direction to FIG. 8.
Figure 13:
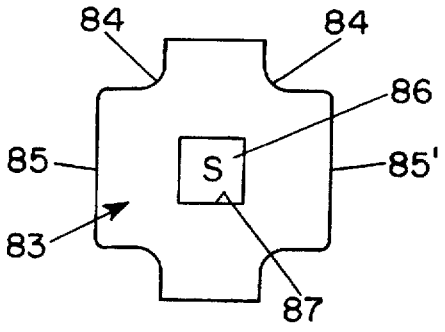
FIG. 13 is a plan view of a beam transverse partition that serves to support and position the legs of the controls coils.
Figure 14:
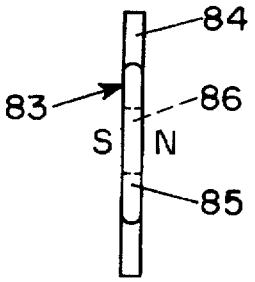
FIG. 14 is a view of the edge of the partition of FIG. 13.

This critical relationship is most clearly shown in FIG. 11. Elongated coils 80 and 80$^1$ lying against the channels 40 and 40$^1$, respectively, (see also FIG. 6) serve to generate an electromagnetic control field perpendicular to the planes of the channels when energized and thus exert a control torque on the rotor magnets which is in equilibrium with a restoring torque at a desired attitude of the louvers, as will be described in detail hereinafter.

The louvers 20 are corrugated ribbons of high-strength aluminum foil. The axes of the corrugations extend parallel to the width dimension to stiffen the louver transversely and to render it longitudinally resilient.

The corrugations are formed by passing work-hardened flat foil between the engaging involute teeth of a pair of spur gears in a rapid and continuous operation. Very thin foil can be employed to maximize resilience and to minimize sag when the louvers are hung horizontally. The thinness of the foil permits the necessary longitudinal resilience to be obtained with such fine corrugations (much exaggerated in FIG. 5) that the louvers look essentially flat and give an extraordinarily unobstructed view when fully open. This resilience accommodates thermal expansion or contraction of the louvers without noticeable change in sag, and it also compensates for unavoidable variation in the spacing between the beams. A full consideration of this type of louver is found in U.S. Pat. No. 3,342,244 dated Sep. 19, 1967.

Each louver terminal 21 is formed with a pair of coextensive rectangular leaves 22 and 23 of aluminum integral with a return bend or transverse centerfold 24. Centered on the centerfold is a circular hole 25 through which attachment is made to the rotor magnet 50. A tongue 27 that is lanced from the longitudinal centerline of the leaf 23 passes through a hole in the louver on its longitudinal axis and projects through a semicircular hole 26 in the leaf 22. The tip of the tongue 27 is flattened against the outside of the leaf 22, leaving sliding clearance between leaves 22 and 23 for the corrugations of the louver. The louver hangs on the tongue 27 with freedom to pivot slightly into alignment with the rotational axis 104.

Figure 6:
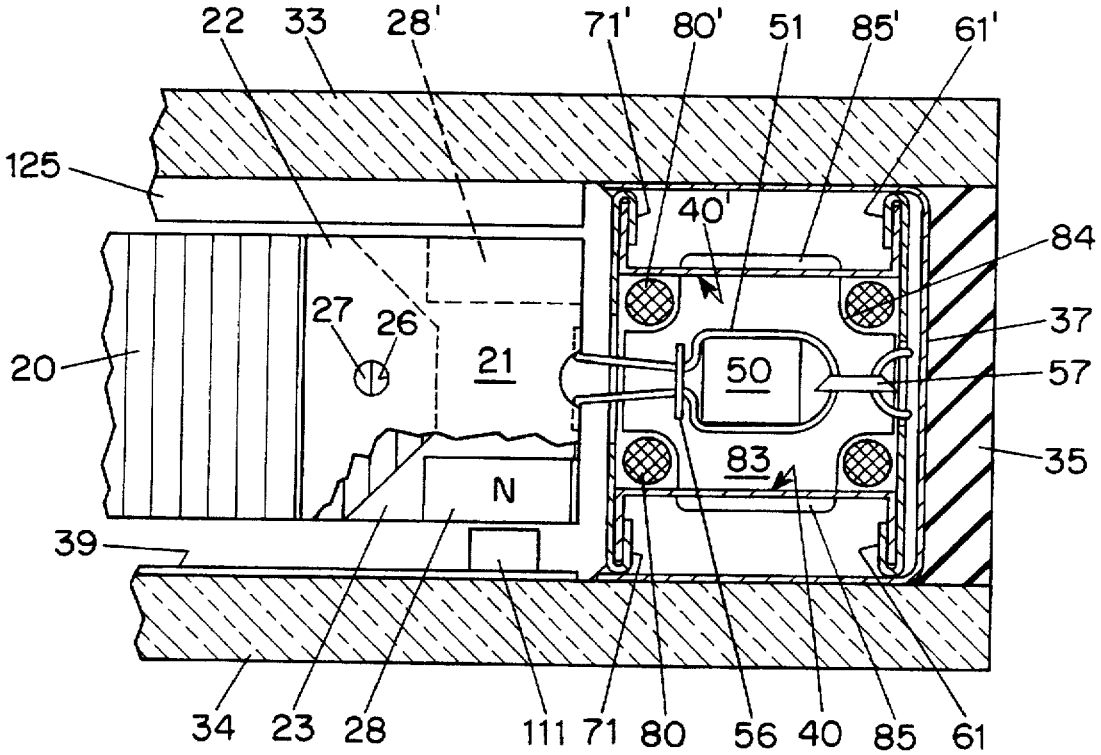
FIG. 6 is a cross section of the screen portion shown in FIG. 5 taken along dashed line 6—6.

Each louver terminal 21 is preferably provided with a pair of latching magnets 28 and 28$^1$ shown in FIG. 6. The latching magnets are magnetized through the thickness dimension, which is approximately equal to the overall thickness given the louver corrugations, permitting the magnets 28 and 28$^1$ to be fixed between the leaves 22 and 23 adjacent opposite longitudinal edges thereof. The polarities of magnets 28 and 28$^1$ are reversed. The direction of magnetization of latching magnets on corresponding sides of adjacent terminals is likewise reversed; consequently corresponding sides of adjacent terminals are mutually repellant. However, the magnets on opposite sides of adjacent terminals are similarly directed and mutually attractive. Accordingly, the magnets latch together in the overlapping closed attitude.

A full disclosure of magnetically latching louvers is found in U.S. Pat. No. 5,357,712 dated Oct. 25, 1994.

Figure 7:
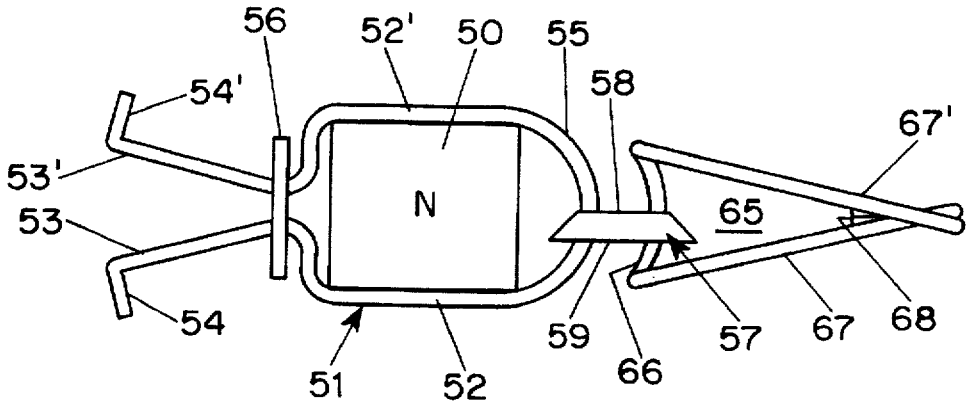
FIG. 7 shows in enlarged detail a rotatable subassembly comprising a magnet rotor, rotor armature, collar, truncated conical link and suspension fastener for supporting the rotatable components on a screen beam.

The torsionally rigid connector between the louver terminal 21 and its respective rotor magnet 50 comprises an armature 51 most clearly seen in FIG. 7. The armature 51 is formed from round, non-magnetic spring steel wire and has a pair of parallel magnet gripping portions 52 and 52$^1$, which resiliently hold the rotor. An integral U-bend 55 joins the portions 52 and 52$^1$ and provides a point of suspension. The free ends of the magnet gripping portions converge around the magnet toward the axis of rotation, pass through a constrictive collar 56, and then extend as diverging legs 53 and 54$^1$, which terminate in studs 54 and 54$_1$, respectively, that project in opposite directions. The axial hole 25 gives the studs access to the interior of the terminal 21. The studs 54 and 54$^1$ lie along the foldline 24 with the legs 53 and 53$^1$ resiliently pressing against opposite edges of the hole 25. Adhesive (not shown) prevents any displacement of the magnet 50 from the axis 104. All portions of the armature 51 lie in a common plane, which is symmetrical about the rotational axis and perpendicular to the magnetic axis of the rotor 50.

Rotation of each louver 20 and its associated rotor magnet 50 relative to the beam 31 is facilitated by a self-aligning suspension comprising a conical link 57 that couples the U-bend 55 of the armature to a suspension fastener 65, which is supported by the beam 31.

Figure 9:
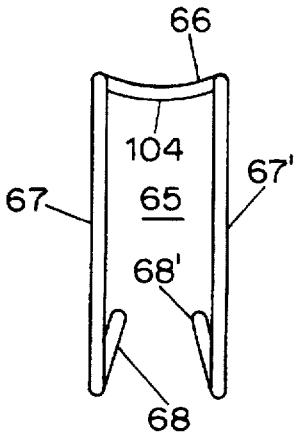
FIG. 9 is a greatly enlarged view of a louver and rotor magnet suspension fastener.
Figure 10:
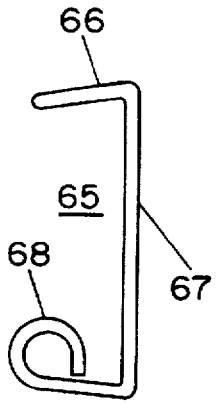
FIG. 10 the suspension fastener perpendicularly to FIG. 9.

The suspension fastener 65, shown separately in FIGS. 9 and 10, has a semicircular saddle 66 upon which the conical link 57 hangs. A pair of legs 67 and 67$^1$ extend from the saddle and are cross-hooked to prevent inadvertent decoupling of the link and fastener, permitting the rotor magnet, armature, collar, link, and fastener to be handled as a subassembly.

The link 57 is a truncated hollow cone or conical ring, which provides a circular aperture 58 having a diameter coaxial with the rotational axis 104. The link may be conveniently formed from thin, e.g. 0.2 mm thick, spring-tempered beryllium copper, which has the edge of its aperture 58 deburred and rounded as by shot peening.

Limited rotation can take place at the contact between the anticlastic surfaces of the link aperture 58 and the U-bend 55 and at the contact between the aperture 58 and the saddle 66. U.S. Pat. No. 4,797,591 dated Jan. 10, 1989 teaches that when the radius of convexity along a transverse plane section of each contacting surface is an order of magnitude smaller than the radius of concavity along a longitudinal plane section of the respective surface, no mechanical restoring torque arises over the operational range of rotational angles. The frictional torque at angles of ±45° between the planes of the contacting surfaces is only twice the torque that exists when the planes are perpendicular to each other.

The circular base 59 of the conical link 57 acts to predetermine the minimum angle between its anticlastic suspension as will be explained with reference to FIGS. 15–17.

The beam 31 has a generally rectangular hollow box-like cross section with two sides provided by the pair of channels 40 and 40$^1$. A rotor suspension web 60 and a rotor access web 70 form the other two sides. Short flanges 41 and 42 extend from channel 40 away from Channel 40$^1$. Corresponding flanges 41$^1$ and 42$^1$ extend from channel 40$^1$ away from channel 40. Web 60 has rims 61 and 61$^1$ that overlap and clamp against flanges 41 and 41$^1$, respectively. Likewise, web 70 has rims 71 and 71$^1$ that overlap and clamp against flanges 42 and 42$^1$, respectively.

The rotor access web 70 is penetrated by round holes 72 centered on the axes 104 and of sufficient diameter to give the rotors 50 access to the interior of the beam 31.

The rotor suspension web 60 is perforated along its longitudinal centerline by a series of square holes 62, which have parallel opposite edges 63 and 64 perpendicular to the centerline. The rotational axes 104 intersect the midpoints of edges 63 on which hang the saddle 66 of the suspension fastener 65.

Each fastener 65 is attached to the exterior of the web 60 between the edge 63 of one hole 62 and the edge 64 of the next hole. The saddle 66 protrudes perpendicularly to the legs 67 and 67$^1$ over the edge 63 into the interior of the beam 31. The outer diameter of the saddle is equal to the width of the hole 62; consequently the point of contact between the saddle and the conical link lies on the axis 104.

At a distance equal to that between the edge of one square hole and the edge 64 of the next hole, the legs 67 and 67[1] are formed with a substantially perpendicular bend toward the interior of the beam and terminate in closed eyes 68 and 68[1] respectively, which rest underneath the edge 64 when in final position.

Seating the suspension fastener 65 on the rotor suspension web 60 is accomplished by a simple button-hooking type of action The cross-hooked legs 67 and 67[1] are picked up adjacent the parallel eyes 68 and 68[1] and drawn through the hole 62 until the saddle 66 reaches the edge 63. The legs are then rotated toward the web 60 until the eyes reach the edge 64 of the adjacent hole. Moderate force perpendicular to the plane of the web momentarily bends the legs and causes the eyes to clip over the edge 64, thereby fixing the position of the saddle 66 against the edge 63 of the first hole.

A beam cover 37 in the form of a thin metal channel of U-shaped cross section is placed on top of the web 60 after all the fasteners 65 have been mounted. The beam cover extends from the rims of web 60 to the rims of web 60 and provides flat surfaces level with the exterior sidewalls of the strut 32, which support the glass plates.

The construction of the test beam avoids welded joints and thus permits easy disassembly and reassembly to provide an adjustable spacing between the beam sidewalls for empirically determining the precise separation required for permanent magnetic torque balance. This dimension once decided upon is fixed by the length of non-magnetic cylindrical tubular spacers 43, shown in FIGS. 8 and 11, installed as needed along the beam at midpoints between rotational axes.

Each spacer 43 is positioned by a non-magnetic screw 45 that enters the beam through a hole 44 in the channel 40, passes through the tubular interior of the spacer, projects out of the beam through a hole 44[1] in the channel 40[1] opposite hole 44, and is secured by a nut, which holds the beam sidewalls tightly against the ends of the spacer.

Figure 18:
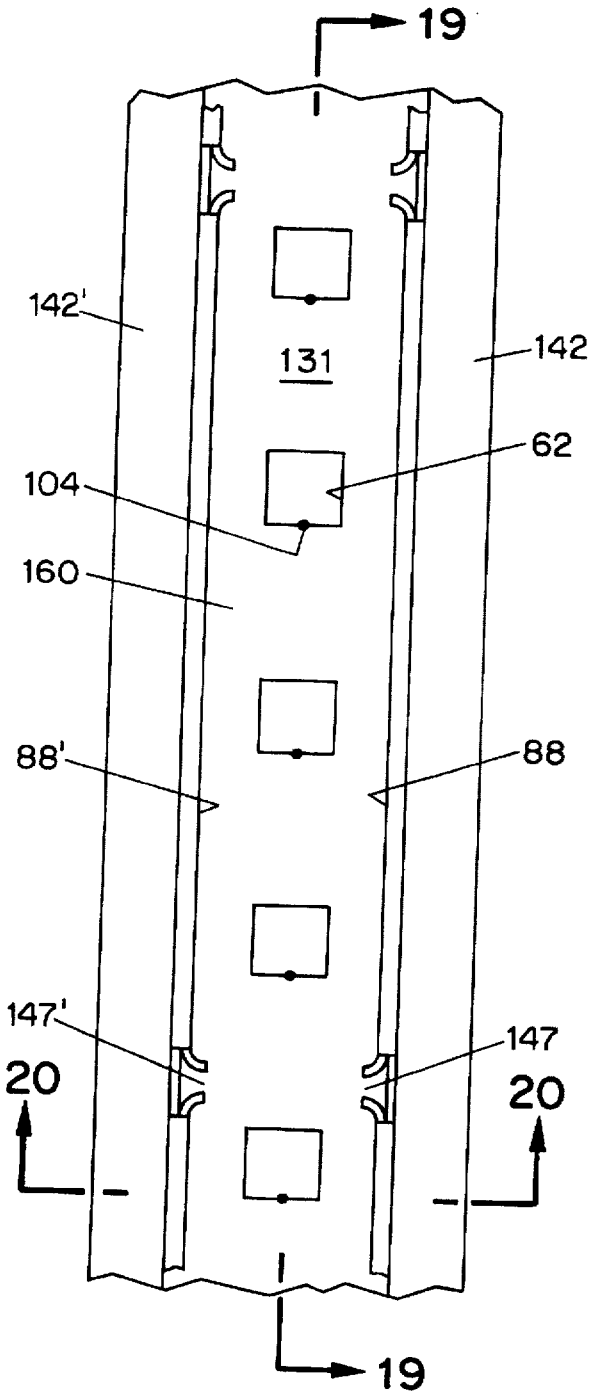
FIG. 18 a plan of the interior of a portion of an integral screen beam showing non-magnetic strips for locating beam transverse partitions.
Figure 19:
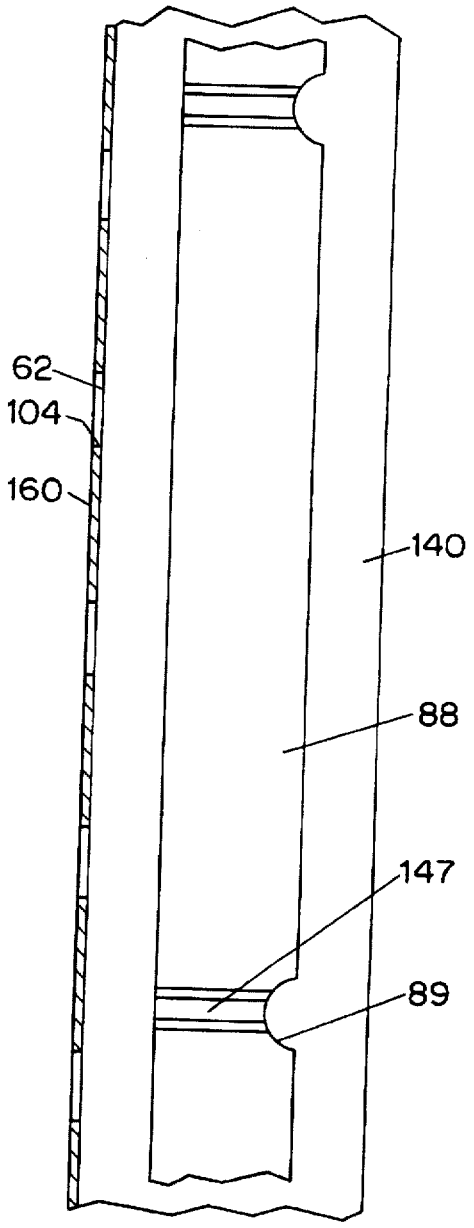
FIG. 19 a longitudinal section of the beam of FIG. 18 taken along dashed centerline 19—19.
Figure 20:
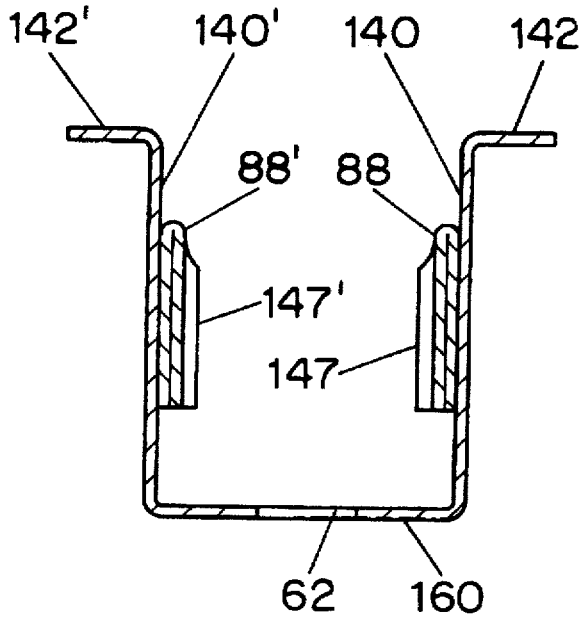
FIG. 20 is a cross section of the beam of FIG. 18 taken along dashed line 20—20.

A commercial beam 131 shown in FIGS. 18–20 combines the channels 40 and 40[1] with the rotor suspension web 60 in a unitary construction where the sidewall spacing is precisely fixed by welding the beam to the web 70, and the spacers 43 are omitted.

Coil supporting partitions 83 are provided, each comprising a smooth flat thin member having an outline suggesting a Greek cross formed by removing arcuate notches 84 from the corners of a rectangle. The partitions are preferably molded from electrically insulating synthetic material. The overall length is substantially equal to the interior depth of the beam, and the width between parallel edges 85 and 85[1] is somewhat greater than the spacing between the sidewalls.

A restoring torque magnet 86 is fixed in an aperture 87 formed in the center of each partition 83. The magnet 86 is preferably a small square slice of barium ferrite having equal thickness with the partition. The magnetic axis of the magnet 86 is aligned with the centerline 101 intersecting the centers of the adjacent rotor magnets. Not only is barium ferrite inexpensive and temperature resistant, but it is particularly suitable because its recoil permeability is only slightly greater than unity. Accordingly, the stabilizing torque is not disturbed by the presence of the magnet 86. Only one restoring torque magnet is needed for every four rotor magnets because of the unifying effect of these stabilizing torques.

Each partition 83 is positioned by a pair of short narrow slots 47 and 47[1] oppositely disposed and transversely centered in the channels 40 and 40[1] respectively, at midpoints between rotational axes. The slots 47 and 47[1] accommodate the edges 85 and 85', respectively, when the sidewalls are sprung slightly apart to allow entry and thereafter hold the partition perpendicularly to the longitudinal axis of the beam.

Figure 12:
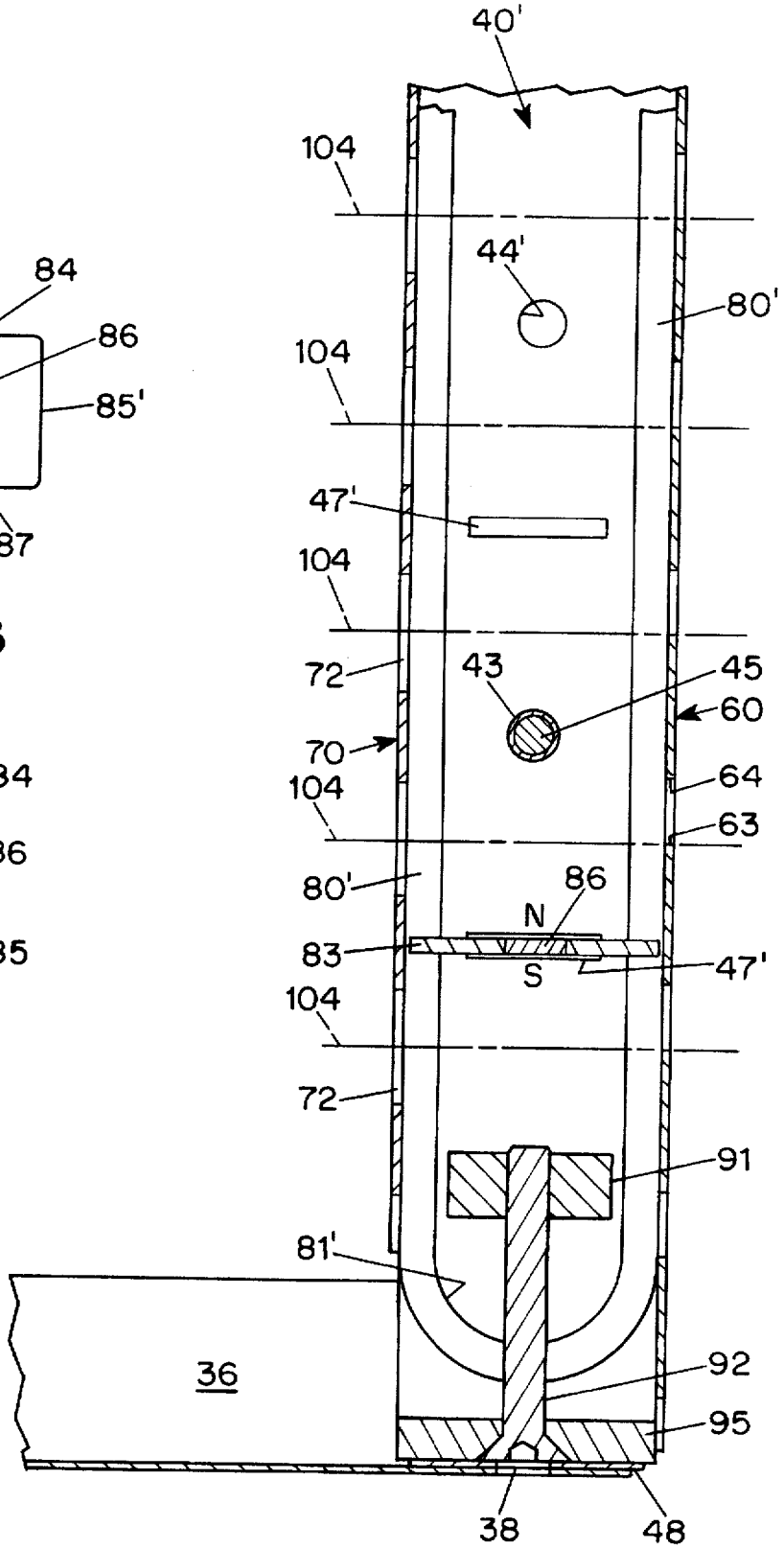
FIG. 12 is a central longitudinal section of a portion of the screen beam before it forms part of a rectangular screen frame, showing a projecting corner connector suitable for insertion into the open end of a strut.

One of the coils that generates the electromagnetic control field is clearly shown in FIG. 12. Coil 80[1] has a pair of parallel multi-turn legs, which extend past all the rotors 50 in the beam with a return bend 81[1] adjacent the end of the strut 32 and a corresponding return bend (not shown) at the other end of the beam to complete the winding. The coils 80 and 80[1] are held against the channels 40 and 40[1], respectively, by the arcuate notches 84 of the partition 83. One leg of a coil is supported in each notch 84, which is rounded in thickness dimension to avoid coil abrasion.

The first and last rotor magnets in each beam only couple with magnets on one side; consequently the undiminished locking torque caused by magnetism induced in the channels results in torque unbalance. Compensation is provided by magnetism induced by the end rotor in a steel plug 91, which is threaded on a screw 92. The plug 91 makes sliding contact with the channels between the legs of the coils 80 and 80[1]. Accordingly, rotation of the screw 92 adjusts the distance between the plug and the adjacent rotational axis 104. The head of the screw is countersunk in a channel spacer 95.

The torque compensating assembly is inserted in the beam at the time that the coils are installed. Thereupon the spacer 95 is attached to a yoke 48 that serves as an end connector between the channels. The yoke retains the recessed head of the screw 92 in the channel spacer 95, permitting screw rotation without axial movement.

A longitudinal section of the corner connector 36 is shown in FIG. 12 projecting perpendicularly to the web 60 and 70 of the beam. The connector 36 has a U-shaped cross section that slides into the end of the strut 32, as seen in FIG. 11. The base of the connector is bonded to the yoke 48, and a hole 38 is provided through both members to give access to the recessed head of the screw 92. Final torque compensating adjustment can be performed at the corners of the screen after all the louvers have been attached but before the glass plates are added.

It is desirable to prevent rotation of the individual louvers appreciably exceeding the positive and negative closed attitudes where $\lambda=\pm 90°$ to ensure the parallel closure of all louvers and uniformity of locking torques.

It is unsatisfactory to lance tabs outwardly from the web 70 at midpoints between adjacent axes 104 to provide angular limit stops on the central plane of the screen, because the tabs leave gaps between adjacent closed louvers, which leak light and heat. Furthermore, such limit stops prevent contact between the overlapping edges of the louver terminals 21 and thus reduce the magnetic latching attraction. Also unavoidable displacements of the rotational axes from the centers of the rotor access holes cause noticeable variations in the angular limits.

A suspension link 57 in the form of a frustum of a hollow thin-walled right cone offers very slight frictional torque over a desired range of rotational angles $\lambda$, but movement is abruptly stopped at a positive and negative angle $\alpha$ between the plane of the link aperture 58 and the plane of the arcuate saddle 66 of the suspension fastener 65 by contact between the conical base 59 and the saddle.

Figure 15:
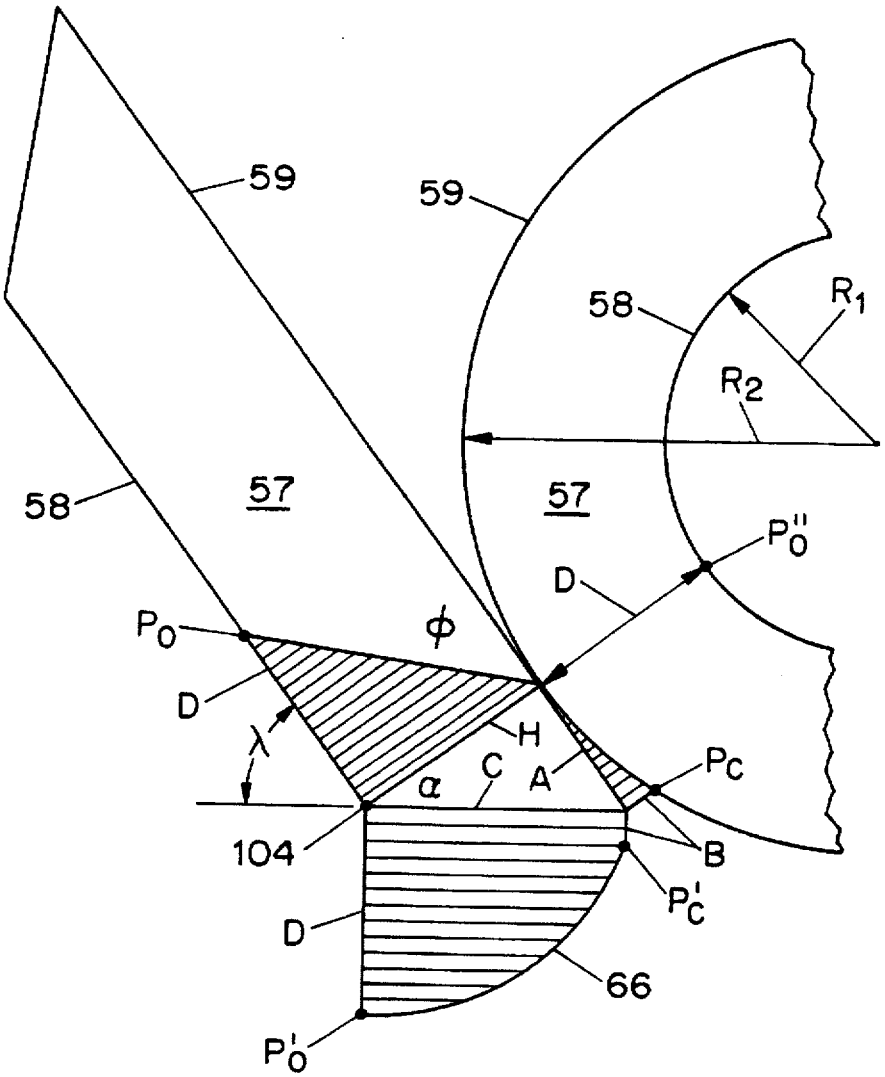
FIG. 15 is a geometric diagram illustrating the relationship between the axis of rotation of a truncated hollow thin-walled right conical link and the point on an anticlastic supporting member at which the base of the link makes contact and stops further rotation.

FIG. 15 is a diagram that illustrates the functional relationship between the limiting angle $\alpha$ and the height H of the conical link 57, as measured from the base 59 to the parallel plane of the aperture 58. The radius $R_1$ of the aperture 58, the radius $R_2$ of the base 59, and the radius $R_3$ of the saddle 66 are constants selected on the basis of other considerations, leaving the conical height H to be evaluated as a function of a predetermined angle α or the angle a evaluated if the value H is already chosen.

In a plane perpendicular to the axis 104 and tangent to the circumference of the base 59, a line H is drawn from the axis 104 to the point of tangency. A second line A is drawn from the tangent point perpendicularly to H, and a further line C coplanar with the saddle 66 extends at an angle α with respect to line H from the axis 104 to intersect with line A and complete a right triangle.

Attached to the three sides of the triangle are shaded areas that represent views perpendicular to the respective sides and to the axis 104. It is evident that if these areas are folded down 90°, points $P_0$ and $P_0$ coincide with the axial point $P_0$ on the aperture 58 from which it is supported at a distance D below the plane of the triangle HAC.

The circumference of the base 59 intersects the arcuate saddle 66 at a distance B below the plane of the triangle and the point of contact $P_c$ coincides with the point $P_c$.

Figure 16:
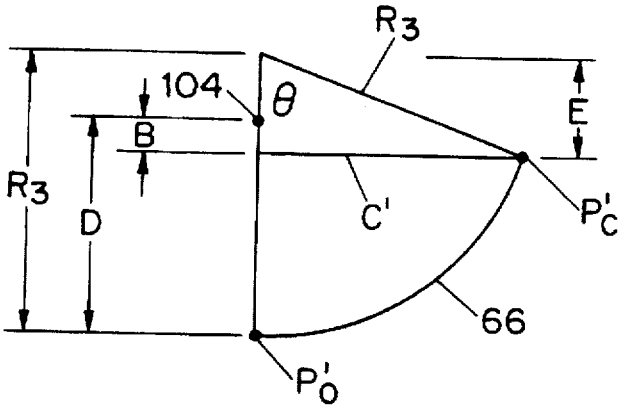
FIG. 16 is a trigonometric diagram illustrating the central angle subtended by the circular arc of the anticlastic supporting member, which arc extends from the pivot point of the conical lick to the contact point that determines the maximum rotational angle of the link.

Referring to FIG. 16, it is observed that a knowledge of B and $R_3$ determines the central angle θ subtended by the circular arc of the saddle 66, which extends from the axial point $P_0$ to the contact point $P_c$.

An inspection of FIGS. 15 and 16 enables us to list the following relationships:

$A=H\tan\alpha$ $B=R_2-(R_2^2-A^2)^{1/2}$ $C=H\cos\alpha$ $D=R_2-R_1$ $E=R_3+B-D$ $C'=C$ $\theta'=\sin^{-1}C/R_3$ $\theta=\cos^{-1}E/R_3$ and $\phi=\tan-1H/D$.

The correct value of the unknown variable is that which satisfies $\theta'=\theta$.

For example, given $R_1=1.5$ mm, $R_2=3.0$ mm, $R_3=2.0$ mm and choosing H=1.5 mm gives $\alpha=36.6°$ and an angular range of $\lambda=\pm53.4°$. Consider now the rotation between the U-bend 55 of the rotor armature 51 and the identical conical link 57, where $R_3=3.0$ mm and H=1.5 mm. These values result in $\alpha=47.9°$ and thus $\lambda=\pm42.1°$. Accordingly, the total available range of louver rotation is $\lambda=\pm95.5°$ in this case.

Figure 17:
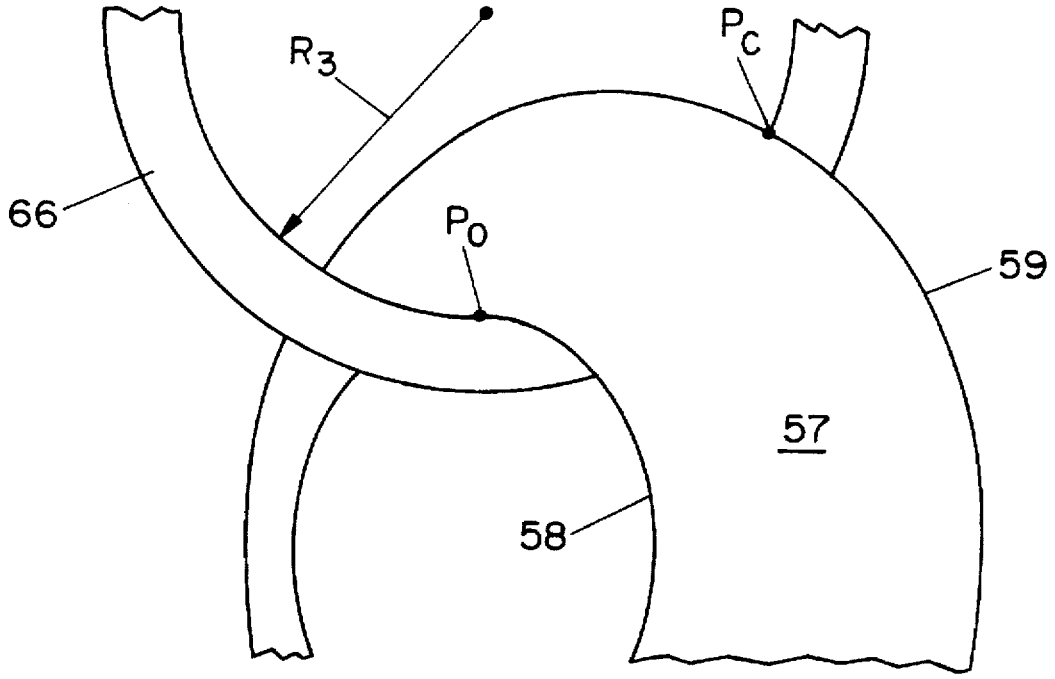
FIG. 17 is a detail on a greatly enlarged scale of the conical link at the limited angle where the cone base makes contact with the anticlastic supporting member, viewed perpendicularly to the plane of the supporting member.

FIG. 17 is a detail of the conical link 57 turned to the minimum angle with respect to the saddle 66 of the suspension fastener 65 where the cone base 59 makes contact at the point $P_c$ on the saddle, viewed perpendicularly to the plane of the saddle.

The adjustability inherent in the assembled construction of the beam 31 is well adapted to a test screen, but a unitary beam 131 shown in FIGS. 18–20 is more suitable for commercial production.

The beam 131 comprises a channel Of magnetically soft thin steel strip having a hollow rectangular cross section formed by a rotor suspension web 160 and integral sidewalls 140 and 140¹. Short flanges 141 and 141¹ extend perpendicularly outwards from the free ends of sidewalls 140 and 140¹, respectively. The portions 160, 140, 140¹, etc. of beam 131 correspond to components 60, 40, 40¹ of beam 31.

Figure 21:
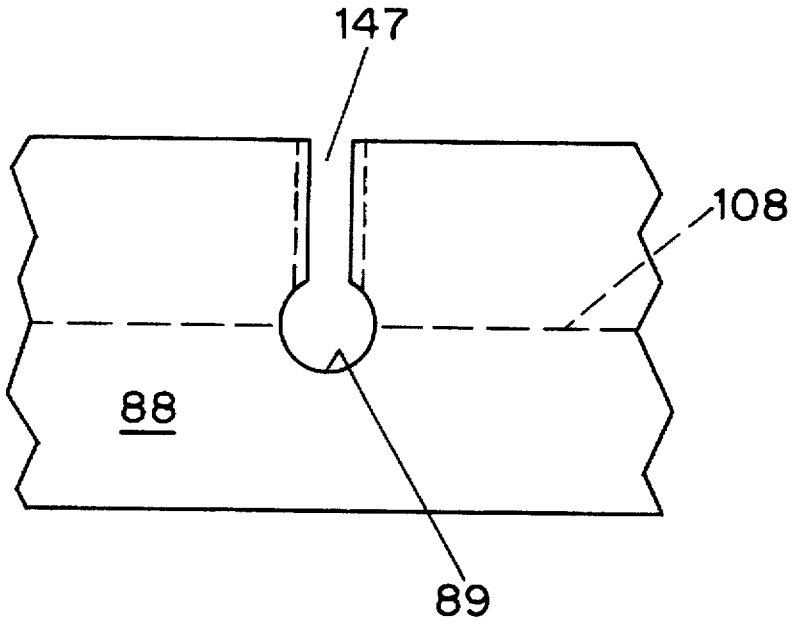
FIG. 21 is a detail of a partially formed partition locating strip prior to folding it in half about its longitudinal centerline.

Positioning the coil supporting partitions 83 is achieved by the provision of locating strips 88 and 88¹, which are secured to the interior faces of the sidewalls 140 and 140¹, respectively. The strips 88 and 88¹ extend along the beam 131 in the central portions of the sidewalls, leaving space for the parallel legs of respective control coils. Each strip 88 and 88¹ is made of non-magnetic sheet material folded in half about a longitudinal centerline 108 (see FIG. 21) to provide a portion that extends uninterruptedly from the return bend of the respective control coil at one end of the beam 131 to the return bend at the opposite end. The other longitudinal halves of the strips 88 and 88¹ are periodically interrupted by oppositely disposed slots 147 and 147¹, respectively, at midpoints between rotational axes 104 that are separated by a predetermined number of axial spaces, say four.

The slots 147 and 147¹ are formed by slitting perpendicularly from an edge of strips 88 and 88¹ to holes 89 that are centered on the longitudinal centerline 108. The diameter of the holes 89 is sufficient to permit the slits to be expanded into slots of suitable width to accommodate the thickness of the partitions 83. The width of the partitions between parallel edges 85 and 85¹ is reduced to clear the continuous halves of the strips 88 and 88¹.

Sliding the partitions 83 into the beam 131 is not only easier than inserting the edges 85 and 85¹ into the slots 47 and 47¹, respectively, in the beam 31, but the absence of perforations in the sidewalls 140 and 140¹ permit them to correspond more nearly to the parallel magnetically permeable boundaries of infinite extent assumed in the theory of operation.

A further feature of strips 88 and 88¹ is that the folded portions between the partition locating slots 147 and 147¹, respectively, serve to limit transverse displacement of the magnet rotors and prevent them from contacting the steel sidewalls 140 and 140¹, respectively, if subjected to severe mechanical shock during handling. The axial tension on the rotors might otherwise be insufficient to overcome the attracting force, which increases very rapidly as the rotors approach the sidewalls.

An important feature of the screen is its ability to be controlled by a central energy management computer and/or by a room occupant. Accordingly, the operation of the screen is discussed with reference to a remote control circuit illustrated in FIG. 22.

Figure 22:
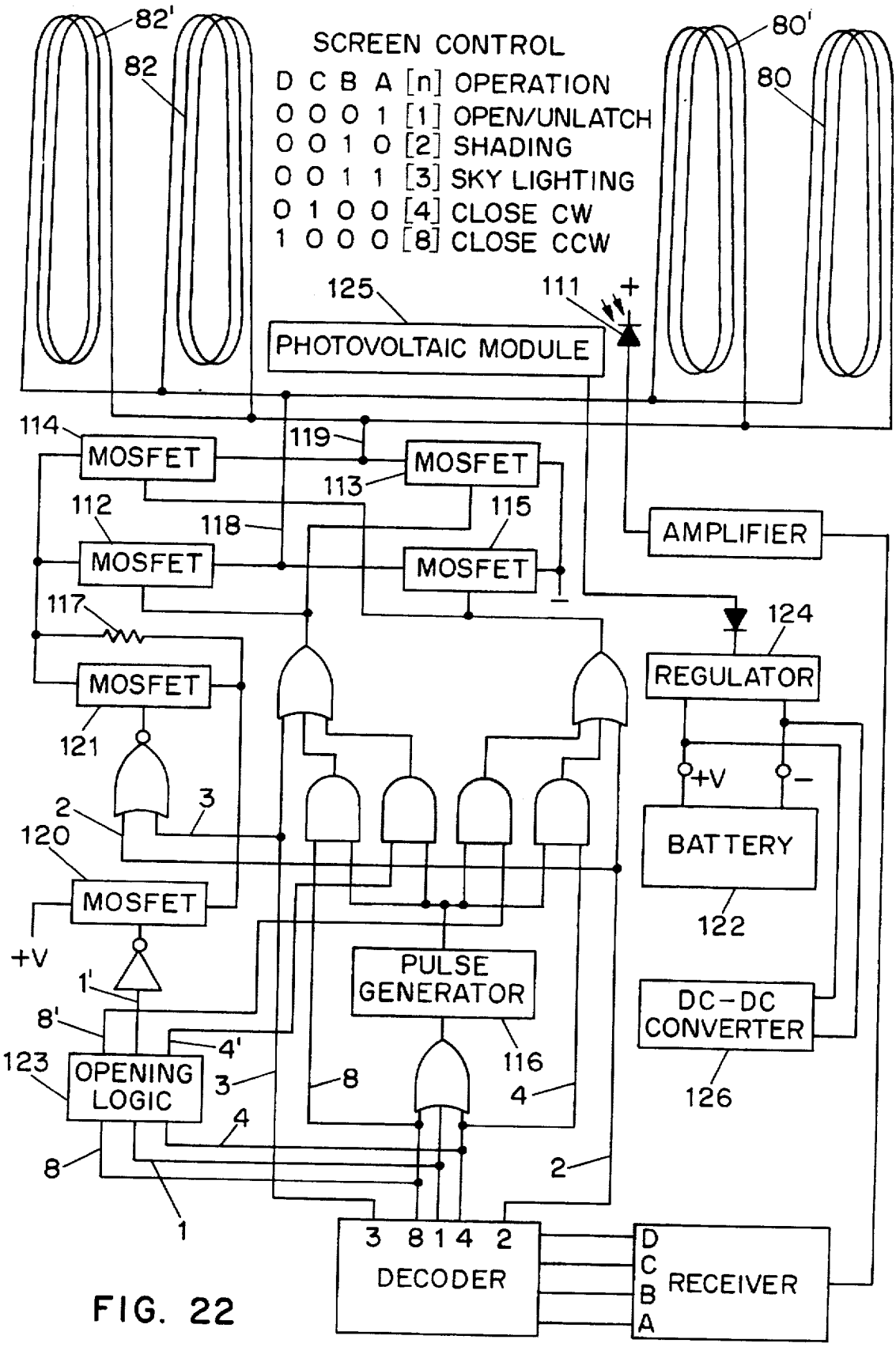
FIG. 22 is a schematic wiring diagram of the connections between a photovoltaic module, a current regulator, rechargeable batteries, an infrared receiver and a decoder of remote control signals, and an output interface that supplies current from the batteries to electromagnetic control field coils in accordance with the decoded signals.

FIG. 22 is a block diagram of a control system that responds to remote control signals detected by a photodiode 111 (see FIGS. 5 and 6). The photodiode operates in reverse bias mode and is protected from ambient light by packaging in a side-viewing black infrared transmissive plastics case. The control signals are supplied as a series of nine-bit words, the first five bits comprising an address and the last four bits being data.

The detected signals are passed through an amplifier, which is actually integral with the photodiode 111 and applied to a receiver that checks the address bits with its own address. If the incoming address matches the address assigned to the receiver and the data bits are identical in two successive words, the data is transferred to output data latches A, B, C and D for as long as the same data is received.

The data latches A, B, C and D are connected to a 4-line to 10-line decoder, which converts the binary data to decimal outputs 1–9. A table of screen control is given in FIG. 22 where five basic operations are listed, shading output 2 and skylighting output 3 correspond to louver attitudes, say, $\lambda=-45°$ and $+45°$, respectively. A practical screen installation would permit several more intermediate louver attitudes, but illustrating the additional circuitry would needlessly complicate FIG. 22.

Output 3 is connected by an OR logic buffer to the gate terminals of a pair of MOSFET switches 112 and 113, and output 2 is connected by a separate OR logic buffer to the gate terminals of a second pair of MOSFET switches 114 and 115. The switches 112–115 are n-channel enhancement MOSFETs, which each conduct when a positive potential is applied to its respective gate terminal.

The source terminal of MOSFET 112 and the drain terminal of MOSFET 115 are connected to a coil lead 118, while the source of MOSFET 114 and the drain of MOSFET 113 are connected to a second coil lead 119. Leads 118 and 119 supply current to parallel-connected coils 80, 80$^1$, 82 and 82$^1$. The coils 82 and 82$^1$ represent the control field windings in the second beam (not shown) opposite the beam 31.

Current flows through the windings in one direction when output 3 is high, and it flows in the opposite direction when output 2 is high, thereby reversing the magnetic control field. Accordingly, the action of the MOSFETs 112–115 is analogous to a double-pole changeover relay.

Positive potential is applied to the drains of MOSFETs 112 and 114 through MOSFETs 120 and 121, which are connected in series. MOSFET 120 is supplied from a battery 122 and is conductive except when decoder output 1 is high and the previous output is neither 4 nor 8. This conditional output 1$^1$ is determined by an opening logic circuit 123, the operation of which is discussed with reference to FIG. 23. Accordingly, signal 1$^1$ is applied through a NOT gate to turn off the MOSFET 120 and terminate all current in the field coils.

MOSFET 121 conducts except when the decoder output 2 or 3 is high. This control is realized by applying the signal 2 or 3 to a NOR circuit that is connected to the gate of the MOSFET. Current flows only through a parallel resistor 117 in the presence of one of these signals. The resistance of resistor 117 is chosen to give the desired attitude of the louvers in the shading or skylighting mode.

Outputs 4 and 8 are connected through an OR logic gate to a pulse generator 116 that feeds two AND gates, one controlled by output 4 and the other controlled by output 8. The pulsed output 8 triggers MOSFETs 112 and 113, and the pulsed output 4 triggers MOSFETs 114 and 115.

The transient louver attitudes resulting from the pulses of current flowing through the control coils are shown in FIG. 4. The portions 106 and 106$^1$ of the current curve represent screen closing pulses, which peak at flat portions 107 and 107$^1$, respectively, where the louvers have reached attitudes of about $\lambda=\pm 75°$, and magnetic latching attraction takes effect. The louvers abruptly assume latched closed attitudes of about $\lambda=\pm 85°$. The pulse from generator 116 terminates in less than one second, and the current through the coils 80, 80$^1$, 82 and 82$^1$ drops to zero. However, the louvers remain latched closed with the decoder output 4 or g high. Under this condition the latching torque slightly exceeds the restoring torque. The relevant output 4 or 8 is stored in the logic circuit 123 for future comparison with output 1 when unlatching and opening the louvers is desired.

Figure 23:
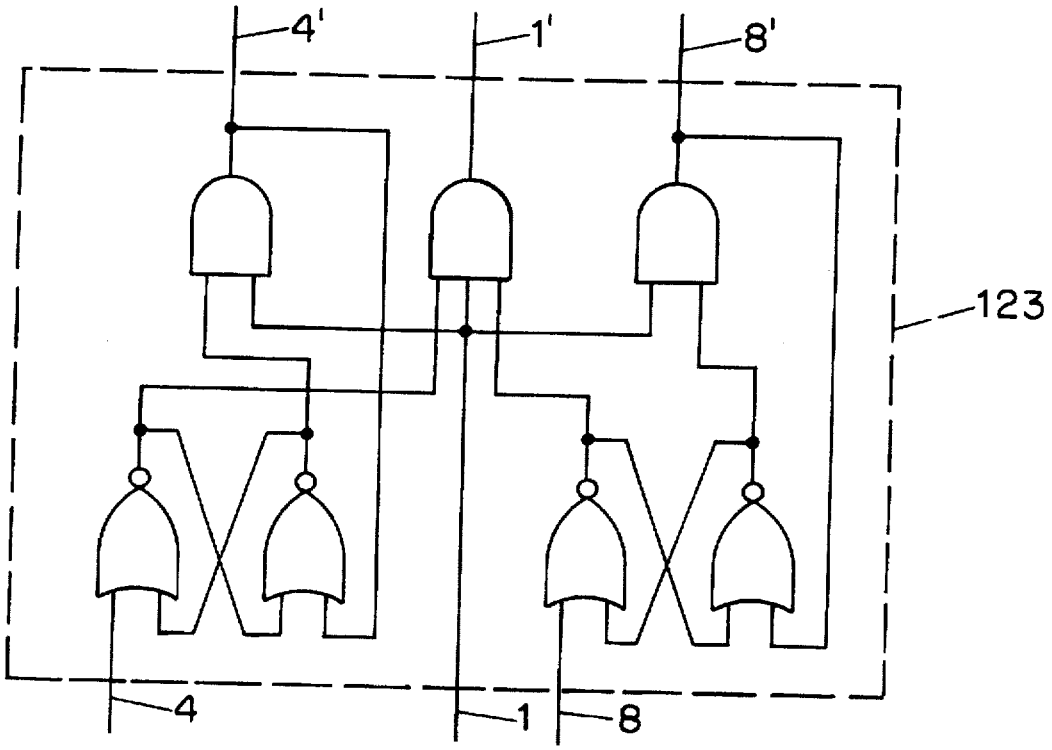
FIG. 23 is a schematic diagram of a logic circuit that ensures opening the screen wide in response to a single control signal irrespective of the previous attitude of the louvers.

A schematic diagram of the logic circuit 123 is shown in FIG. 23. Two bistable flip-flops are provided, each comprising a pair of cross-connected NOR gates. Output 4 sets one flip-flop and output S sets the other flip-flop. Once set, the flip-flop remains in that state and serves as a memory until reset. The outputs of the flip-flops are applied to respective AND gates together with decoder output 1. When output 1 and stored 4 or output 1 and stored 8 are present, the relevant flip-flop is reset and a signal 4$^1$ or 8$^1$, respectively, initiates an unlatching pulse of suitable polarity to allow the restoring torque to return the louvers to a fully open attitude with zero control field current.

This action is realized by employing output 1 to trigger the pulse generator 116. The resulting pulse is applied to two additional AND gates that are enabled by signal 4$^1$ and 8$^1$, respectively. Signal 4$^1$ causes MOSFETs 112 and 113 to conduct, and signal 8$^1$ causes MOSFETs 114 and 115 to conduct. The polarities of these pulses are opposite to the pulses correspondingly to outputs 4 and 8, respectively. The unlatching pulses are shorter than to the latching pulses in practice, but only a single pulse generator 116 is shown to avoid further complexity in FIG. 22.

The conditional output 1$^1$ is supplied from the logic circuit 123 by means of a third AND gate connected to output 1 and to both flip-flops in a manner to enable the gate only in the absence of stored signals 4 and 8.

A particular advantage of the logic circuit 123 is that a central computer can transmit signal 1 and supersede existing attitudes of the louvers of screens previously set by room occupants. All screens can then be simultaneously adjusted from common wide open attitudes.

A screen that is installed in a vertical plane facing south in the northern hemisphere under climatic conditions of generally sunny but cold winters has every opportunity to be cost-effective. Such a screen having a low iron, tempered exterior glass plate serves as an ideal enclosure for a thin-film polycrystalline photovoltaic module 125, which is shown in FIGS. 5, 6, 11 and 15. The module 125 is a narrow strip bonded to the glass plate 33 adjacent and parallel to the strut 32. The module extends alongside the strut to as near its end as practicable, given the need to restrict the number of different lengths of module manufactured. The width of the module shown is 1.5 s, where s=16 mm, the spacing between rotational axes. Accordingly, the area dedicated to the module in a typical screen 1000 mm high is 2.4%. A shield strip 39 may be used against the glass plate 34 to hide the back of the module 125.

The module 125 supplies current through a regulator 124 to the battery 122, which is detachably connected to terminals attached to the indoor face of the glass plate 34. The circuit is completed by a pair of conductors that pass through the sealant 35 and around the edge of the plate 34. A DC to DC converter 126 is contained within the screen enclosure to provide low voltage for the logic and control circuits.

Louver attitudes are changed most frequently during sunny weather, but the energy consumed is easily replaced because maximum photovoltaic current is generated under this condition. The open circuit voltage of the module must be substantially higher than that of the batteries 122 to provide useful current when exposed to overcast skies. Fortunately, the louvers remain stationary all day under adverse daylight conditions, and energy, apart from the quiescent current of the control circuits, is only used to open the louvers in the morning and close them at night. The design problem of the photovoltaic module is to satisfy the quiescent current of the control circuits during possible long periods of heavy cloud cover and short daylight.

The elimination of all external wiring makes a self-sustaining screen particularly effective for installation above eye level in clerestories, skylights or atria where thermal and daylighting efficiency can be maximized without causing glare.

The previous detailed description of a screen having louvers that are supported at both ends and mounted in a dual-glazed enclosure should not obscure the potential advantages of magnetic stabilization in vertical blinds where the louvers, typically strips of synthetic material, are mounted indoors and supported only at their upper ends, the lower ends being weighted.

I claim:

1. An adjustable screen comprising a plurality of louvers having equally spaced coplanar longitudinal axes of rotation, bipolar permanent magnet rotors having axes of rotation, one attached to a corresponding end of each louver coaxial with the respective longitudinal axis, means having parallel magnetically permeable sidewalls spaced apart on opposite sides of said coplanar axes to enclosed said rotors, and means for supplying a magnetic field for turning said rotors, thereby adjusting the attitude of said louvers, characterized in that said sidewalls are spaced apart relative to said axial spacing to balance effectively a mutual coupling torque on said rotors by equal and opposing locking torque on said rotors caused by magnetic induction in said sidewalls.

2. A screen according to claim 1 wherein said means for supplying a magnetic field comprises means for directing at least a component of said field along the common plane of said axes of rotation of said rotors.

3. A screen according to claim 2 wherein said means for directing at least a component of said field comprises a plurality of permanent magnets having recoil permability less than 2 fixed on said common plane at midpoints between selected pairs of adjacent rotors.

* * * * *

UNITED STATES PATENT AND TRADEMARK OFFICE

CERTIFICATE OF CORRECTION

PATENT NO. : 5,718,274

DATED : February 17, 1998

INVENTOR(S) : Edward C. Streeter

It is certified that error appears in the above-indentified patent and that said Letters Patent is hereby corrected as shown below:

Col.1, line 8, "concern should read --concerns -- Col. 1, line 16, "dosed" should read --closed--; Col. 2, line 1, "end" should read --and--; Col. 2, line 37, "a of" should read --a diagram of--; Col. 2, line 64, "FIG. 10" should read --FIG. 10 views--; Col. 4, line 17, "$\alpha=\beta+$" should read --$\alpha=\beta+\Delta$--; Col. 4, line 25, "&poles" should read --dipoles--;

Col. 6, line 25, "shown" should read --shown in--; Col. 6, line 38 "fight" should read --right--; Col. 6, line 47, "time" should read --frame--; Col. 7, line 64, "$54^1$" should read --$53^1$--; Col. 7, line 64, "$54_1$" should read --$54^1$--; Col. 9, line 20, "web 60 to ... " should read --web 70--; Col. 9, line 40, "where should read --wherein--; Col. 11, line 4, "angle a" should read --angle $\alpha$--; Col. 11, line 38, "tan-1H/D" should read --$\tan^{-1}H/D$--; Col. 11, line 57, "Of should read --of--; Col. 13, line 51, "g high" should read --8 high--; Col. 13, line 59, "output S" should read --output 8--;Col. 15, line 9, "enclosed" should read --enclose--.

UNITED STATES PATENT AND TRADEMARK OFFICE

CERTIFICATE OF CORRECTION

PATENT NO. : 5,718,274

DATED : February 17, 1998

INVENTOR(S) : Edward C. Streeter

It is certified that error appears in the above-indentified patent and that said Letters Patent is hereby corrected as shown below:

Col. 4, line 56, "$P_n$ or $P_n$" should read --$P_n^1$ or $P_n^{-1}$--.

Col. 5, line 2, "$P_0$ and $P_0$" should read --$P_0^1$ and $P_0^{-1}$--.

Signed and Sealed this

Twenty-first Day of July, 1998

Bruce Lehman

*Attest:*

*Attesting Officer*

BRUCE LEHMAN

*Commissioner of Patents and Trademarks*